US006181221B1

(12) United States Patent
Kich et al.

(10) Patent No.: US 6,181,221 B1
(45) Date of Patent: Jan. 30, 2001

(54) REFLECTIVE WAVEGUIDE VARIABLE POWER DIVIDER/COMBINER

(75) Inventors: Rolf Kich; James M. Barker, both of Redondo Beach, CA (US)

(73) Assignee: Hughes Electronics Corporation, El Segundo, CA (US)

( * ) Notice: Under 35 U.S.C. 154(b), the term of this patent shall be extended for 0 days.

(21) Appl. No.: 09/167,053

(22) Filed: Oct. 6, 1998

(51) Int. Cl.[7] ..... H01P 1/161; H01P 5/04; H01P 9/00

(52) U.S. Cl. ..... 333/125; 333/137; 333/21 A; 333/157

(58) Field of Search ..... 333/125, 126, 333/135, 137, 21 A, 157

(56) References Cited

U.S. PATENT DOCUMENTS 3,166,724 * 1/1965 Allen ..... 333/157 X
3,622,921 * 11/1971 Heeren ..... 333/21 A
3,668,567 * 6/1972 Rosen ..... 333/21 A
5,376,905 * 12/1994 Kich ..... 333/137

FOREIGN PATENT DOCUMENTS

572293 * 12/1993 (EP) ..... 333/157

* cited by examiner

*Primary Examiner*—Benny Lee
(74) *Attorney, Agent, or Firm*—Terje Gudmestad

(57) ABSTRACT

A reflective waveguide variable power divider/combiner comprises an orthomode tee section, which includes a section of cylindrical waveguide and a rotatable reflective phase shifter section. The rotatable reflective phase shifter section is rotatably connected to the orthomode tee section by a cylindrical choke joint. The orthomode tee section includes a single orthomode tee unit. The reflective waveguide variable power divider/combiner terminates at a short circuit that separates a motor from the rotatable reflective phase shifter section. The motor is configured to rotate the rotatable reflective phase shifter section relative to the orthomode tee section.

25 Claims, 3 Drawing Sheets

20
+45°
0 deg
Component A
Component B
-45°
22
23
24
26
28
30
32
34
36
38
40
42
44
46
48
52
53
54
56
58
60
62
64

REFLECTIVE WAVEGUIDE VARIABLE POWER DIVIDER/COMBINER

BACKGROUND OF THE INVENTION (a) Field of the Invention

The present invention relates generally to an electromagnetic power divider/combiner and, more particularly, to a power divider/combiner having a movable slow-wave structure disposed in a portion of the cylindrical waveguide.

(b) Description of Related Art

A vertically oriented electromagnetic signal can be described as having two orthogonal components: a first component oriented at +45 degrees relative to the vertical and a second component oriented at −45 degrees relative to the vertical. Similarly, a horizontally oriented electromagnetic signal can be described as having two orthogonal components: a first component oriented at +45 degrees relative to the vertical and a second component oriented at +135 degrees relative to the vertical. The differential phase differences between the vertical and horizontal orientations (180 degrees) form the basis for the operation of a variable power divider/combiner (VPD/C). The orthogonal components of the two orientations can be manipulated using the VPD/C to create power splits at the output ports of the VPD/C.

One form of microwave circuit of interest herein provides for a switching of power from any one of two input ports to any one of two output ports, as well as dividing the power of either of the two input ports among the two output ports. The circuit also operates in reciprocal fashion to enable a combining of power received at the two output ports to exit one of the input ports.

An example of such a device is disclosed in the form of a rotary vane power divider in U.S. Pat. No. 5,376,905, the entirety of which is hereby incorporated by reference. The power divider disclosed in the '905 patent includes two orthomode tee to cylindrical waveguide adapters coupled by a slow-wave structure (also known as a phase shifter or delay line). The slow-wave structure is disposed between the orthomode tee adapters and includes a plurality of vanes movable to adjust their penetration through the sidewall of the waveguide section. A motor mounted to the side of the waveguide section is used to move the vanes with respect to the waveguide section.

The length and therefore the weight of such a unit is larger than desired for some applications, such as on spacecraft, where the weight and volume of equipment is preferably minimal. In addition, the weight taken up by the gearing for the side drive motor can be burdensome. An alternative to such a motor arrangement is to have a relatively complex and heavy circumference drive unit to rotate the waveguide.

Accordingly, there is a need for a small, light-weight VPD/C, to minimize or eliminate the aforementioned problems.

SUMMARY OF THE INVENTION

In accordance with one aspect of the present invention, an electromagnetic power divider/combiner comprises a waveguide, a first input port and a first output port. The first ports are operative to couple an electromagnetic wave at a first orientation to the waveguide. The electromagnetic power divider/combiner further comprises a second input port and a second output port, each being operative to couple an electromagnetic wave at a second orientation (e.g., orthogonal to the first orientation) to the waveguide, and a slow-wave structure. A short circuit is disposed at an end of the waveguide opposite the first and second ports for reflecting electromagnetic energy.

Preferably, the waveguide is cylindrically shaped and the slow-wave structure comprises a series of fins oriented transversely of a longitudinal axis of the waveguide and spaced apart from one another along the longitudinal axis of the waveguide. The slow-wave structure preferably includes a plurality of pairs of fins, each of which comprises an upper fin and a lower fin substantially coplanar with the upper fin. Also preferably, a septum is mounted to the short circuit and the slow-wave structure is rotatably movable with respect to the first input port, the first output port, the second input port and/or the second output port. A motor, coaxial with the longitudinal axis of the waveguide is used to rotate the slow-wave structure.

In accordance with another aspect of the present invention, a method for splitting an electromagnetic signal between two orthogonal orientations is provided. The method comprises the steps of propagating the signal in a first direction through a plurality of fins, reflecting the signal and propagating the signal in a second direction opposite to the first direction through the plurality of fins.

DESCRIPTION OF THE PREFERRED EMBODIMENT

Figure 1:
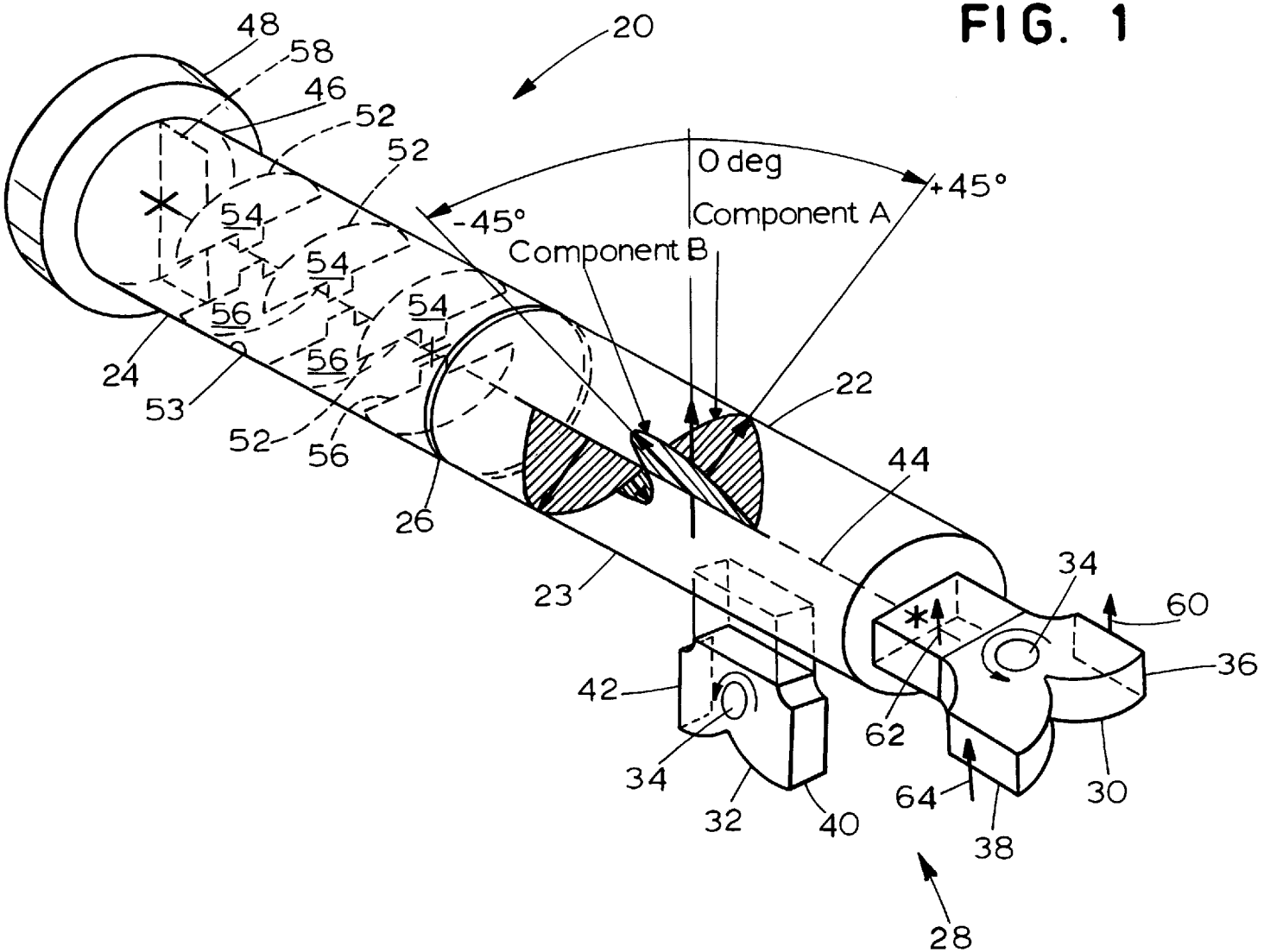
FIG. 1 is a perspective view of a reflective waveguide variable power divider/combiner in accordance with the present invention, including a rotatable reflective phase shifter section and an orthomode tee section.

Referring initially to FIG. 1, a reflective waveguide variable power divider/combiner, generally designated at 20, comprises an orthomode tee section 22, which includes a section of cylindrical waveguide 23 that is made of electrically conductive material, such as aluminum or copper, and a rotatable reflective phase shifter section 24. The rotatable reflective phase shifter section 24 is made of electrically conductive material, such as aluminum or copper, and is rotatably connected to the orthomode tee section 22 by a cylindrical choke joint 26. The orthomode tee section 22 includes a single orthomode tee unit, generally designated at 28, that includes a vertical isolator 30, for propagating vertically oriented electromagnetic waves, and a horizontal isolator 32, for propagating horizontally oriented electromagnetic waves.

The vertical isolator 30 and the horizontal isolator 32 each include a circulator 34 for differentiating between incoming and outgoing signals. The vertical isolator 30 includes a vertical input port 36 and a vertical output port 38. Similarly, the horizontal isolator 32 includes a horizontal input port 40 and a horizontal output port 42.

The reflective waveguide variable power divider/combiner 20 extends along a longitudinal axis 44, terminating at a short circuit 46 that is made of electrically conductive material, such as aluminum or copper, and that separates a motor 48 from the rotatable reflective phase shifter section 24. The motor 48 is configured to rotate the rotatable reflective phase shifter section 24, about the longitudinal axis 44, relative to the orthomode tee section 22.

The motor 48 is operatively connected to the rotatable reflective phase shifter section 24 in any suitable manner. For example, a rotor (not shown) associated with the motor 48 can be directly attached to the rotatable reflective phase shifter section 24, in which case the motor 48 is coaxial with the longitudinal axis 44.

The rotatable reflective phase shifter section 24 includes three planar fin pairs 52. Each planar fin pair 52 is made from an electrically conductive material and is mounted to an interior wall 53 of the phase shifter section 24. Each planar fin pair 52 is oriented substantially orthogonally to the longitudinal axis 44 and includes an upper fin 54 and a lower fin 56 that is coplanar with the associated upper fin 54.

The planar fin pairs 52 form a slow-wave structure that, when positioned as shown in FIG. 1, results in a retardation of signals oriented in the vertical direction but no retardation of signals oriented in the horizontal direction. Vertically oriented signals propagating from the vertical input port 36 toward the short circuit 46 are retarded by the planar fin pairs 52 and then reflected by the short circuit 46, after which the vertically oriented signals are again retarded by the planar fin pairs 52 upon traveling from the short circuit 46 to the vertical output port 38. A 180 degree phase inversion occurs at the short circuit 46, but does not impact the relative phase difference between the orthogonal components of the signal that is reflected off of the short circuit 46. A septum 58, made of electrically conductive material, such as aluminum or copper, is mounted to the short circuit 46 in order to properly reflect either vertically or horizontally oriented signals. The dimensions of the planar fins 52, as well as the number of planar fins 52 used will be dependent upon the attributes of the specific signal that is desired to be divided or combined by the cylindrical reflective waveguide variable power divider/combiner 20.

The cylindrical reflective waveguide variable power divider/combiner 20 operates as follows. In the configuration shown in FIG. 1, a vertically oriented signal, depicted by a vertical arrow 60, launched from the vertical input port 36 consists of two equal orthogonal components at +45 degrees (component A) and −45 degrees (component B). These orthogonal components propagate along the longitudinal axis 44 into the rotatable reflective phase shifter section 24 and reflect back off of the short circuit 46, passing through the reflective phase shifter section 24 a second time. Since the two orthogonal components are each oriented at a 45 degree angle with respect to the vertical, each component receives a partial phase retardation of 90 degrees due to the planar fin pairs 52. However, as both orthogonal components are equally affected, there is no relative phase difference between the components. Thus, the orthogonal components can be recombined into the vertical orientation, depicted by a vertical arrow 62, before the outgoing signal is differentiated from the incoming signal (depicted by the vertical arrow 60) by the circulator 34 in the vertical isolator 30. The outgoing signal exits from the vertical isolator 30 through the vertical output port 38, as depicted by a vertical arrow 64. (FIGS. 1 through 3 each include a depiction of a single cycle of the waveform of each component of the outgoing signal.)

Figure 2:
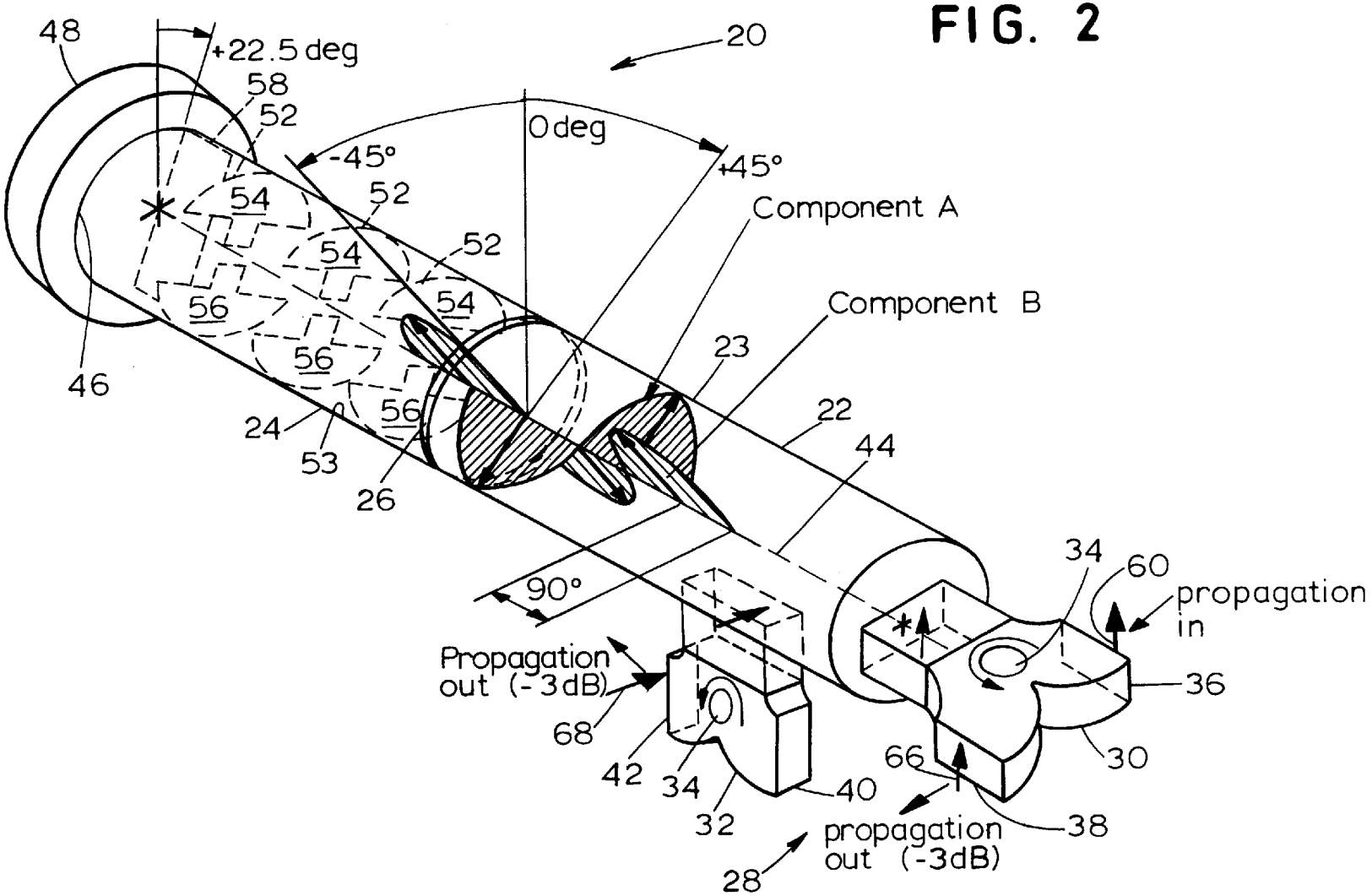
FIG. 2 is a perspective view of the reflective waveguide variable power divider/combiner of FIG. 1, wherein the rotatable reflective phase shifter section is angularly displaced by 22.5 degrees relative to the orthomode tee section.

If the rotatable reflective phase shifter section 24 is rotated by the motor 48 to an angle of 22.5 degrees, as shown in FIG. 2, the orthogonal components of the vertical signal 60 entering through the vertical input port 36 will now be separated by 90 degrees. FIG. 2 depicts a vertically oriented signal, having two orthogonal components at +45 degrees (Component A) and −45 degrees (Component B), after propagation of the vertical signal through the phase shifter section 24, rotated to +22.5 degrees, and reflection back off of the short circuit 46. The 90 degree separation, as illustrated, occurs because the +45 degree component (component A) receives a 135 degree phase retardation after passing through the rotatable reflective phase shifter section 24, and the −45 degree component (component B) receives only a 45 degree phase retardation after passing through the rotatable reflective phase shifter section 24. This set of conditions creates a circular polarization (C.P.) in the cylindrical reflective waveguide variable power divider/combiner 20. Accordingly, the signal is split equally at −3 dB such that −3 dB signals exit at each of the vertical output port 38, as depicted by a vertical arrow 66, and the horizontal output port 42, as depicted by a horizontal arrow 68, after passing through the respective circulator 34.

Figure 3:
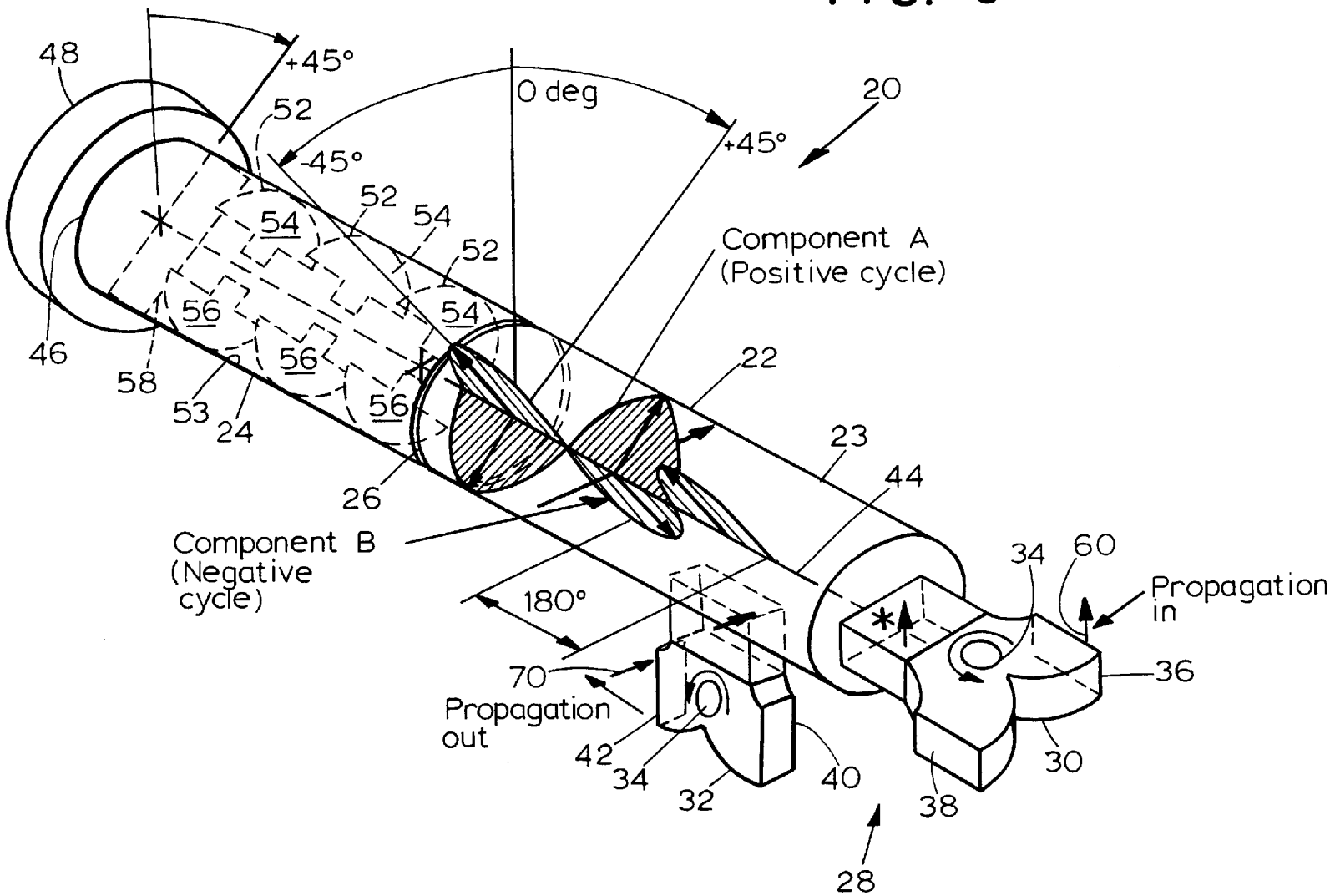
FIG. 3 is a perspective view of the reflective waveguide variable power divider/combiner of FIG. 1, wherein the rotatable reflective phase shifter section is angularly displaced by 45 degrees relative to the orthomode tee section.

If the rotatable reflective phase shifter section 24 is rotated by the motor 48 to a 45 degree position, as shown in FIG. 3, the +45 degree component (component A) receives a full 180 degree retardation since it passes between the upper fins 54 and the lower fins 56. FIG. 3 illustrates a vertically oriented signal, having two orthogonal components at +45 degrees (Component A) and −45 degrees (Component B), after propagation of the vertical signal through the phase shifter section 24, rotated to +45 degrees, and reflection back off of the short circuit 46. The resultant 180 degree separation, as illustrated, occurs because the −45 degree component (component B) receives no phase retardation since it is exactly orthogonal, and centered on the upper fins 54 and the lower fins 56. After passing through the rotatable reflective phase shifter section 24, the +45 degree component and the −45 degree component have a relative phase difference of 180 degrees. The positive cycle of the +45 degree component can then be combined with the negative cycle of the −45 degree component (at 135 degrees), and the negative cycle of the +45 degree component (at 225 degrees) can be combined with the positive cycle of the −45 degree component, yielding a resultant signal in the horizontal orientation. The resultant signal in the horizontal orientation exits from the horizontal output port 42, as depicted by a horizontal arrow 70, after passing through the circulator 34 in the horizontal isolator 32.

The rotatable reflective phase shifter section 24 has been shown in FIGS. 1, 2 and 3 to be at angles relative to vertical of zero, 22.5 and 45 degrees, respectively. However, the rotatable reflective phase shifter section 24 can be rotated to any desired angle by the motor 48, allowing any desired power split combination to be achieved. Elliptical polarization signals can be achieved at intermediate angles (e.g., 30 degrees relative to vertical) of the rotatable reflective phase shifter section 24.

The reflective waveguide variable power divider/combiner 20 is also reciprocal. With the rotatable reflective phase shifter section 24 at a 22.5 degree position, two incoming signals of equal phase entering the vertical input port 36 and the horizontal input port 40 can be combined to form a signal having twice the power of the incoming signals.

The reflective waveguide variable power divider/combiner 20 has several advantageous features, as compared to conventional variable power divider/combiners. First, the length (and therefore the weight) of the reflective waveguide variable power divider/combiner 20, is less than that of a conventional VPD/C, as it requires half the number of fins and only one orthomode tee section and associated choke joint. Also, the need for complicated and heavy side drive transmissions or circumference drive transmissions is eliminated as the motor 48 may be directly mounted to the phase shifter section 24.

The reflective waveguide variable power divider/combiner 20 can be used in any waveguide system, such as Ku-Band, Ka-Band or C-Band systems.

While the present invention has been described with reference to specific examples, which are intended to be illustrative only, and not to be limiting of the invention, as it will be apparent to those of ordinary skill in the art that changes, additions and/or deletions may be made to the disclosed embodiments without departing from the spirit and scope of the invention. For example, the geometry and/or number of the upper and lower fins 54, 56 could be varied without departing from the spirit and scope of the invention.

What is claimed is:

1. An electromagnetic power divider/combiner comprising:

a waveguide having a major axis and a circular cross section orthogonal to said major axis;

a first input port and a first output port, said first input port and said first output port both disposed near a first end of said waveguide, said first input port being operative to couple a vertically polarized electromagnetic wave to said waveguide and said first output port being operative to couple said vertically polarized electromagnetic wave from said waveguide;

a second input port and a second output port said second input port and said second input port both disposed near said first end of said waveguide, said second input port being operative to couple a horizontally polarized electromagnetic wave to said waveguide and said second output port being operative to couple said horizontally polarized electromagnetic wave from said waveguide;

a slow-wave structure comprising a series of fins oriented transversely of said major axis of said waveguide and being spaced apart along said major axis of said waveguide; and a short circuit disposed at a second end of said waveguide opposite said first end of said waveguide for reflecting said vertically polarized electromagnetic wave and said horizontally polarized electromagnetic wave.

2. A method for splitting an electromagnetic signal, said electromagnetic signal including two components having orthogonal orientations, between said two components, the method comprising the steps of:

propagating said electromagnetic signal in a first direction through a plurality of fins to shift the phase of at least one of said two components;

reflecting said electromagnetic signal; and propagating said electromagnetic signal in a second direction opposite to the first direction through said plurality of fins to further shift the phase of said at least one of said two components.

3. An electromagnetic power divider/combiner comprising: a waveguide;

a first input port and a first output port, said first input port and said first output port both disposed near a first end of said waveguide, said first input port being operative to couple an electromagnetic wave at a first orientation to said waveguide and said first output port being operative to couple said electromagnetic wave at said first orientation from said waveguide;

a second input port and a second output port, said second input port and said second output port both disposed near said first end of said waveguide, said second input port being operative to couple an electromagnetic wave at a second orientation to said waveguide and said second output port being operative to couple said electromagnetic wave at said second orientation from said waveguide;

a slow-wave structure located in said waveguide; and a short circuit disposed at a second end of said waveguide opposite said first end of said waveguide for reflecting said electromagnetic wave of said first and second orientations.

4. The electromagnetic power divider/combiner of claim 3, wherein said first orientation is orthogonal to said second orientation.

5. The electromagnetic power divider/combiner of claim 3, wherein said slow-wave structure includes a plurality of pairs of fins.

6. The electromagnetic power divider/combiner of claim 5, wherein each said pair of fins comprises a respective upper fin and a respective lower fin substantially coplanar with said corresponding upper fin.

7. The electromagnetic power divider/combiner of claim 3, further including a septum mounted to said short circuit.

8. The electromagnetic power divider/combiner of claim 3, wherein said slow-wave structure is rotatably movable with respect to said first input port.

9. The electromagnetic power divider/combiner of claim 3, wherein said slow-wave structure is rotatably movable with respect to said first output port.

10. The electromagnetic power divider/combiner of claim 3, wherein said slow-wave structure is rotatably movable with respect to said second input port.

11. The electromagnetic power divider/combiner of claim 3, wherein said slow-wave structure is rotatably movable with respect to said second output port.

12. The electromagnetic power divider/combiner of claim 3, wherein said slow-wave structure is rotatably movable with respect to said first input port by a motor.

13. The electromagnetic power divider/combiner of claim 12, wherein said motor is mounted to said slow-wave structure.

14. The electromagnetic power divider/combiner of claim 13 wherein said waveguide has a longitudinal axis and said motor is coaxial with said longitudinal axis of said waveguide.

15. The electromagnetic power divider/combiner of claim 3, wherein said waveguide is cylindrically shaped.

16. The electromagnetic power divider/combiner of claim 3, wherein said slow-wave structure comprise sa series of fins oriented transversely of a longitudinal axis of said waveguide and spaced apart from one another along said longitudinal axis of said waveguide.

17. The electromagnetic power divider/combiner of claim 3, wherein said slow-wave structure is rotatably movable with respect to said first output port by a motor.

18. The electromagnetic power divider/combiner of claim 17, wherein said motor is mounted to said slow-wave structure.

19. The electromagnetic power divider/combiner of claim 18 wherein said waveguide has a longitudinal axis and said motor is coaxial with said longitudinal axis of said waveguide.

20. The electromagnetic power divider/combiner of claim 3, wherein said slow-wave structure is rotatably movable with respect to said second input port by a motor.

21. The electromagnetic power divider/combiner of claim 20, wherein said motor is mounted to said slow-wave structure.

22. The electromagnetic power divider/combiner of claim 21 wherein said waveguide has a longitudinal axis and said motor is coaxial with said longitudinal axis of said waveguide.

23. The electromagnetic power divider/combiner of claim 3, wherein said slow-wave structure is rotatably movable with respect to said second output port by a motor.

24. The electromagnetic power divider/combiner of claim 23, wherein said motor is mounted to said slow-wave structure.

25. The electromagnetic power divider/combiner of claim 24 wherein said waveguide has a longitudinal axis and said motor is coaxial with said longitudinal axis of said waveguide.

* * * * *